US007381881B1

(12) United States Patent
Sapp

(10) Patent No.: US 7,381,881 B1
(45) **Date of Patent: *Jun. 3, 2008**

(54) SIMULATION OF STRING VIBRATION

(75) Inventor: Markus Sapp, Pinneburg (DE)

(73) Assignee: Apple Inc., Cupertino, CA (US)

( * ) Notice: Subject to any disclaimer, the term of this patent is extended or adjusted under 35 U.S.C. 154(b) by 372 days.

This patent is subject to a terminal disclaimer.

(21) Appl. No.: 10/949,464

(22) Filed: Sep. 24, 2004

(51) Int. Cl.
*G10H 1/00* (2006.01)

(52) U.S. Cl. ..... 84/622; 84/659; 84/600; 84/663; 84/626; 703/2

(58) Field of Classification Search ..... 84/600, 84/622, 626, 658, 647, 662, 663, 659; 703/2
See application file for complete search history.

(56) References Cited

U.S. PATENT DOCUMENTS

| | | | | |
|---|---|---|---|---|
| 4,984,276 | A * | 1/1991 | Smith | 381/63 |
| 5,471,007 | A * | 11/1995 | Van Duyne et al. | 84/622 |
| 5,614,686 | A * | 3/1997 | Van Duyne et al. | 84/622 |
| 6,011,213 | A * | 1/2000 | Duruoz | 84/703 |
| 2005/0115381 | A1* | 6/2005 | Bryden et al. | 84/600 |
| 2005/0154569 | A1* | 7/2005 | Sapp | 703/9 |
| 2006/0021496 | A1* | 2/2006 | Delaporte | 84/743 |
| 2006/0065108 | A1* | 3/2006 | Kergomard et al. | 84/659 |
| 2006/0283311 | A1* | 12/2006 | Hosler | 84/723 |

OTHER PUBLICATIONS http://ccrma.stanford.edu contains many publications relating to modeling and/or synthesis of sound.*

* cited by examiner

*Primary Examiner*—Lincoln Donovan
*Assistant Examiner*—David S. Warren
(74) *Attorney, Agent, or Firm*—Blakely, Sokoloff, Taylor & Zafman LLP

(57) ABSTRACT

A method of simulating a string using a wave equation relates movement of the string in time to force acting on the string, wherein the force acting on the string simulates a stream of a fluid medium flowing relative to the string. The simulated string is supported between two supports and is aligned at rest in a first direction between the two supports, a first of which allows movement in a second direction orthogonal to the first direction and a second of which does not allow movement. The string is then caused from rest to vibrate in a plane, which includes the first and second directions, by turbulence in the fluid flow causing the stream of fluid medium to exert a pressure on the string in the second direction. Movement of the string out of alignment with the first direction causes the stream of fluid medium flowing in the first direction to exert a force on the string in the second direction.

30 Claims, 6 Drawing Sheets

SIMULATION OF STRING VIBRATION

BACKGROUND

The present invention relates to the simulation of vibrations in a string. Such simulation can be used to generate musical sounds by computational means. It is well known that the oscillations of a vibrating string can be modelled and the results converted into sound. Thus, the vibration of each of the strings of a stringed instrument can be modelled by a sound synthesiser.

There are several possible approaches to modelling a vibrating string, for example for use in sound synthesis. One such approach is to describe the modelled string by means of a differential equation, which can then be solved numerically by means of a standard iterative method using a computer. Thus, the wave equation of the modelled vibrating string is solved by iterative successive approximation, as discussed in "Synthesizing Musical Sounds by Solving the Wave Equation for Vibrating Objects": L Hiller and P Ruiz; Journal Audio Engineering Society, 1971, Vol. 19, pp 462-470 (Part I) and 542-551 (Part II). This iterative successive approximation uses finite differences in time and space to solve the equation. Accordingly, this method is known as the finite difference method.

The continuous wave differential equation for a stiff string with one degree of freedom is:

$$M\frac{\partial^2 y}{\partial t^2} = T\frac{\partial^2 y}{\partial x^2} - s\frac{\partial^4 y}{\partial x^4} + L_T\frac{\partial^3 y}{\partial x^2 \partial t} - L_s\frac{\partial^5 y}{\partial x^4 \partial t} - L_v\frac{\partial y}{\partial t} + F(x,t) \quad \text{(Equation 1)}$$

where

F(x, t) denotes an external force at coordinate x on the string at time t;

M denotes mass per length;

S denotes stiffness of the string;

T denotes tension of the string;

Ls denotes a loss associated with the stiffness of the string;

Lt denotes a loss associated with the tension of the string; and

Lv denotes a loss associated with the turbulent flow of the air surrounding the string.

Several conditions are assumed for this wave equation. The first is that the string is rigidly supported at each end and vibrates in one plane only. Thus, every point on the string can only move in a straight line perpendicular to a line joining the end supports. This means that the string does not stretch and vibrate longitudinally. In addition, the amplitude of oscillations of the string is small compared with the string's length. However, the string need not have a uniform density along its length.

Such a string can be modelled as shown in FIG. 1. In FIG. 1, the string 100 comprises a plurality of discrete elements j, from j=0 at the extreme left-hand end to j=x−1 at the extreme right-hand end. The string is rigidly supported at discrete element j=0 at the left-hand end and at discrete element j=x−1 at the right-hand end by supports 110. At rest, all the discrete elements j are aligned in the x-direction. During vibration, the discrete elements j can move only in the y-direction, which is orthogonal to the x-direction. Thus, the plane of vibration is the plane of the paper on which FIG. 1 is drawn. The z-direction is orthogonal to the plane of vibration. The distance between each discrete element is dx.

As shown in "Untersuchungen zur Synthese natürlich erscheinender Klänge": M Sapp; Shaker Verlag, ISBN 3-8265-9318-9, using this model and assuming that dx=1 and dt=1, the solution of the continuous wave equation (Equation 1) can be approximated using the following discrete recursion formula:

$$y[n+1,j]=(y[n,j-2]\cdot c1+y[n,j-1]\cdot c2+y[n,j]\cdot c3+y[n,j+1]\cdot c2+y[n,j+2]\cdot c1+y[n-1,j-2]\cdot c4+y[n-1,j-1]\cdot c5+y[n-1,j]\cdot c6+y[n-1,j+1]\cdot c5+y[n-1,j+2]\cdot c4)/M[j]+2y[n,j]+F[n,j]/M[j] \quad \text{(Equation 2)}$$

in which:

y[n, j] denotes the excursion of discrete element j in the y-direction at time n;

y[n+1, j] denotes the excursion of discrete element j in the y-direction at time n+1;

y[n, j+1] denotes the excursion of discrete element j+1 in the y-direction at time n;

M[j] denotes the mass of discrete element j;

F[n, j] denotes an additional external force acting on a discrete element j at time n; and c1 to c6 are coefficients, which depend on the material parameters of the string and the surrounding media.

More specifically, coefficients c1 to c6 can be calculated as follows:

$$c1=-(S+Ls);$$

$$c2=T+4S+Lt+4Ls;$$

$$c3=-(2T+6S+Lv+2Lt+6Ls);$$

$$c4=Ls;$$

$$c5=-(Lt+4Ls); \text{ and}$$

$$c6=Lv+2Lt+6Ls$$

Since the excursion of elements j=1 to j=x−2 needs to be calculated using the recursion formula and the recursion formula requires elements j−2 and j+2 for calculating the next excursion of element j, additional dummy elements at j=−1 and at j=x are needed. These dummy elements can be visualised as lying at the ends of the strings outside the supports 110. At the rest position at time n=0, these dummy elements are assigned a position in alignment with the other elements. Thus, y[0, −1]=0 and y[0, x]=0. After each calculation of new excursions for all elements, these dummy elements are set to the negated relative excursion of their respective counterpart elements j=1 and j=x−2 on the other side of the supports 110.

Starting from an initial excursion for each of the discrete elements j=0 . . . x−1 at time steps n=0 and n=−1, the excursion y for each discrete element j=1 . . . x−2 (in other words all the discrete elements between the supports) at time n=1 can be calculated using the recursion formula. Accordingly, for each further time step n=2, 3 . . . the new excursions for all elements can be calculated based on the excursions of the previous two time steps and the values of any external forces F[n, j] that have been applied for these time steps. Since the string will initially be at rest, the initial excursion for each of the discrete elements at time steps n=0 and n=−1 will be y[−1, j]=0 and y[0, j]=0 for all j.

Several methods for exciting such a simulated string and hence applying a force to the discrete elements are known. These include exciting the string in a percussive way, for example using a modelled piano hammer or a modelled plectrum to hit, pluck or otherwise strike the simulated string. These modelled strikers may be discretised mass-spring models, possibly with non-linear spring characteristics, that interact with the simulated string to mathematically define F[n, j] for use in the discrete recursion formula (Equation 2). However, if the modelled string is only struck once, then the force F[n, j] acting on the discrete elements j of the simulated string occurs only over a short period of time. Due to the loss coefficients c1 to c6, the string will gradually return to its initial rest state. Thus, the vibrations of the simulated string due to modelled strikers such as piano hammers and plectrums are not self-sustained. The term "self-sustained" is a specific term for an oscillation that is driven by a continuous energy source. In particular, self-sustained oscillations arise when a continuous energy source drives a resonator—such as a string under tension—by means of a non-linear energy coupling.

The only common way to achieve self-sustained vibration of the string is to use a modelled bow, which mimics the action of a bow on a violin or cello. As an example, in one very simplified bow model, the portion of the string being bowed is assumed to be a single point in contact with the bow. As the bow moves in one direction, this single point is deemed to assume a first state, in which it moves with and at the same speed as the bow, and then to assume a second state in which it slips against the bow without friction. Thus, the bow moves in the plane of vibration of the simulated string. This cycle between the first and second states is continuously repeated so long as the bow is moving. The time at which the point transitions from the first mode to the second mode is determined as a function of the bowing pressure. The point transitions from the second mode to the first mode, when the natural vibration of the string causes it to move again in the same direction as the bow. More advanced bow models do not assume the portion of the string being bowed to be a single point in contact with the bow and use non-linear friction characteristics instead of the simple slip-stick mechanism described above.

Self-sustained oscillations in a resonator are also found in wind instruments such as the flute, in which an air jet from the player's lips interacts with the possible standing waves already set up inside the flute. However, the models that are commonly used for simulating wind instruments in sound synthesisers are based on travelling wave models. Travelling wave models are also known as feedback delay loops or waveguide models. In travelling wave models, each interaction point of the travelling wave is modelled as a scattering junction. Thus, compared to string models based on finite differences, travelling wave models are not so well suited for simultaneous interactions with multiple objects such as modelled piano hammers, plectrums and bows.

In addition, it is known that a person can create a sound by holding the two ends of a narrow strip of paper or a blade of grass and blowing between the two ends orthogonal to the length of the strip or blade. Thus, it understood that the strip of paper or blade of grass can be made to vibrate by blowing orthogonal to its length. This vibration is considered to be due to torsional movements of the strip or blade. However, it has not hitherto been established in the prior art how excitement of a blade by orthogonal blowing could be simulated using "one-dimensional" string models. In particular, it is noted that the known string model discussed above could not be used to simulate such excitement, in particular because it is only a one dimensional model (that is, having only one dimension along the length of the string) and it has not hither to been understood how torsional components could be modelled in such a string.

SUMMARY

According to the present invention, there is provided a method of simulating a string using a wave equation that relates movement of the string in time to force acting on the string, wherein the string has a longitudinal axis in a first direction and is moveable in a second direction orthogonal to the first direction, and the force acting on the string simulates a stream of a fluid medium flowing relative to the string in a direction having a component in a third direction orthogonal to both the first and second directions. This simulating may be used to create sounds, which are produced by the string as a result of the force or may be used to create data (e.g. digital data) that represent these sounds, and this data can be processed to produce these sounds.

Preferably, the simulated string is supported between two supports, is aligned at rest in the first direction and has a depth in the third direction, whereby the string has a leading edge closer to a source of the stream of fluid medium and a trailing edge further from the source of the stream of fluid medium.

Preferably, the string is caused from rest to vibrate in a plane, which includes the first and second directions, by turbulence in the fluid flow causing the stream of fluid medium to exert a pressure on the string in the second direction.

Preferably, when the leading and trailing edges are out of alignment with one another, the stream of fluid medium exerts a force on the string in the second direction.

According to the present invention, there is provided a method of simulating a string using a wave equation that relates movement of the string in time to force acting on the string, wherein the string has a longitudinal axis in an x-direction and a depth in a z-third direction orthogonal to the x-direction;

the string is supported between two supports whereby it is aligned at rest in the x-direction and is moveable in a y-direction orthogonal to the x- and z-directions;

and the force acting on the string simulates a stream of a fluid medium flowing relative to the string in a direction having a component in a z-direction, whereby the string has a leading edge closer to a source of the stream of fluid medium and a trailing edge further from the source of the stream of fluid medium. This simulating may be used to create sounds, which are produced by the string as a result of the force or may be used to create data (e.g. digital data) that represent these sounds, and this data can be processed to produce these sounds.

Thus, the present invention provides a method of exciting a string modelled by means of finite differences by "blowing" orthogonally on the string. The ability of the string to be excited simultaneously by hitting, plucking, bowing, and the like may also be maintained.

The present invention provides a method of exciting a string modelled by means of finite differences by "blowing" orthogonally on the string so it can also be excited by hitting, plucking and bowing.

BRIEF DESCRIPTION OF THE DRAWINGS

Embodiments of the present invention will now be described by way of further example only and with reference to the accompanying drawings, in which.

DETAILED DESCRIPTION

Generally, the prior art model of the string assumes that the string is provided in air. Thus, the prior art differential continuous wave equation for a stiff string (Equation 1) includes a loss coefficient, Lv, which denotes a loss associated with the turbulent flow of the air surrounding the string. However, the prior art model of a string at rest shown in FIG. 1 cannot be excited by a stream of air flowing in a direction orthogonal to the string—that is, in the z-direction. In other words, in prior art models it is impossible to generate a sound by simulating a player blowing orthogonal to the length of the string. Moreover, it has not been previously known to simulate blowing orthogonal to the length of a previously excited string to excite the string further. Indeed, no known prior art modelling has been performed to date to simulate blowing on a model string, except that disclosed in co-pending U.S. patent application Ser. No. 10/758,669, also to Markus Sapp, which is hereby incorporated herein by reference. The present invention has been made with a view to overcoming these defects.

Given the invention disclosed in co-pending U.S. patent application Ser. No. 10/758,669, the inventor considered the possibility of adapting the known string model discussed in detail above to include torsional components created by blowing orthogonal to the string. However, it was quickly established that such a model would have a significantly increased processing load. Additionally, adding the possibility of torsional movements would include further restrictions on the allowed model parameters to maintain stability of such a model, which is discrete in time and space.

The present invention overcomes these problems by reinterpreting the known one-dimensional string model in a way that allows excitation by blowing orthogonal to the length of the string. In particular, the present invention seeks to model torsion in a string by simulating components of a force initiated by the blowing, the components of the force being (generally) at right angles to the direction of blowing and (generally) at right angles to the length of the blade In particular, in the present invention the string is conceived of as a thin lamella. In common with the sting of the known model, the lamella has a length orientated in the x-direction and no thickness in the y-direction. However, in contrast with the known model, the lamella has a small but non-zero extension, dz, in the z-direction. The lamella is supported along the width (in the z-direction) of each of its two ends by respective supports 20 so that the ends do not move. Again, the remaining portions of the lamella are allowed to move in the y-direction.

Figure 1:
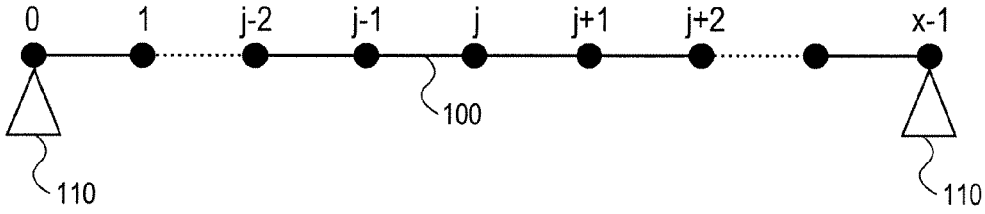
FIG. 1 shows a prior art model of a string at rest.
Figure 2:
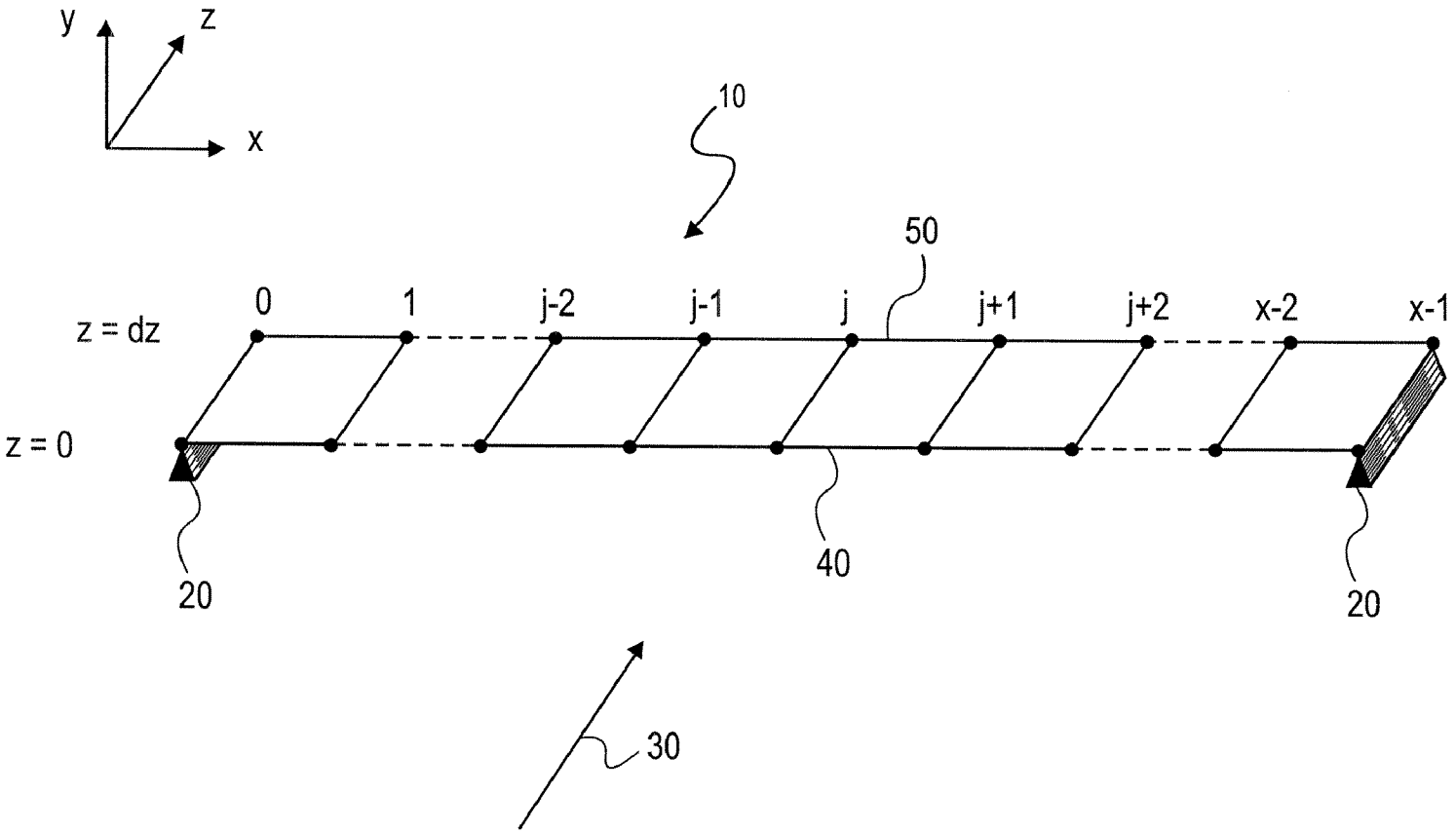
FIG. 2 is a perspective view of a model of a string at rest according to the present invention.

A lamella 10 in accordance with the present invention is illustrated in perspective view in FIG. 2. As is clear from a comparison of FIGS. 1 and 2, the string 100 of the known model and the lamella 10 of the present invention are alike in most respects, except that the lamella 10 is formed as a plane in two directions, the x- and z-directions, instead of a line in one direction, the x-direction. Thus, in common with the string 100, the lamella 10 of the present invention is able to move only in the y-direction. Again, it comprises a plurality of discrete elements j, from j=0 at the extreme left-hand end to j=x−1 at the extreme right-hand end. The lamella 10 is rigidly supported at discrete element j=0 at the left-hand end and at discrete element j=x−1 at the right-hand end by supports 20. At rest, all the discrete elements j are aligned in the x-direction. During vibration, the discrete elements j can move only in the y-direction, which is orthogonal to the x-direction. Thus, the plane of vibration is the plane of the paper on which FIG. 2 is drawn. The z-direction is orthogonal to the plane of vibration. The distance between each discrete element is dx.

However, instead of comprising a plurality of discrete elements each forming a point (j=0, 1 . . . x−1), as in the known, prior art model, the lamella 10 is conceived as comprising a series of discrete elements (j=0, 1 . . . x−1) each forming a line between z=0 and z=dz.

In the present invention, a simulated stream 30 of air or another fluid is blown between the supports 20 in the z-direction. Thus, one edge 40, running along the length of the lamella 10 and closest to the source of the simulated stream 30 of fluid, is a leading edge and the opposite edge 50, furthest from the source of the stream 30 of fluid, is a trailing edge. The leading edge is considered to run along the plane z=0, whilst the trailing edge is considered to run in the plane z=dz.

To avoid the problems of a significantly increased processing load and of increasing the restrictions on the allowed model parameters to maintain stability of such the model, which would arise if torsional movements were to be included in the model, in the present invention the excursion of the leading edge 40 of the lamella 10 is taken to be equal to the current excursion or the known string model, while the excursion of the trailing edge 50 of the lamella 10 is taken to be equal to the excursion at the previous time step.

In other words, the excursion at any point in time n for each element j of the lamella at z=0 can be calculated using the known, prior art model (Equations 1 or 2), whilst the excursion at the same point in time n for each element j at z=dz is assumed to be the excursion of the same element j at z=0 at the previous discrete point in time (n−1).

It has been found that, although not strictly a correct physical model, this model allows the sufficiently accurate estimate of the y-component 60 of a force caused by blowing onto the string in a z-direction for useful, computationally efficient sound simulation.

Specifically, the force 60 in the y-direction experienced by an element j at time n due to the pressure exerted by the stream of fluid 30 flowing in the z-direction can be calculated as follows:

$$F_{PRESz}[n,j]=P_z*(C((y[n,j]-y[n-1,j])/dz))/dt^2*W(j,y[n,j]) \quad \text{(Equation 3)}$$

in which:

$P_z$ denotes the pressure exerted by the stream of fluid 30 on the lamella;

C((y[n, j]−y[n−1, j])/dz) denotes a function of (y[n, j]−y[n−1, j])/dz in respect of the dependency of the force acting on each element j due to the torsion of the lamella; and W(j, y[n, j]) denotes a weighting function representing the intensity of the stream of fluid depending on the current x- and y-position of the element j under consideration.

It is noted that the term (y[n, j]−y[n−1, j])/dz in Equation 3 is effectively a mathematical description of the slope in the y-direction of the line forming the discrete element j moving from the leading edge at z=0, where the excursion is taken as y[n, j] from Equation 2, to the trailing edge at z=dz, where the excursion is taken as y[n−1, j]. Thus, function C relates the force acting on the discrete element due to the torsion of the lamella using this slope.

If the known, discrete recursion formula shown as Equation 2 is to be used, with the simplifying assumptions that dx=1, dz=1 and dt=1, then Equation 3 can be simplified as follows:

$$F_{PRESz}[n,j]=P_z*(C(y[n,j]-y[n-1,j]))*W(j,y[n,j]) \quad \text{(Equation 4)}$$

It is noted that Equations 3 and 4 include a term for pressure. In general, it can be assumed that the lamella is provided in air and has an air jet applied to it. The air jet can be provided from a point or larger source. Thus, its effect on a particular element j will depend on the position of that element j at a particular time n with respect to the position of the source of the air jet. Weighting function W is preferably used in the present invention to model this dependency. In its simplest form, W(u)=u so that the position of the element with respect to the source of the air jet has no effect.

In addition, both the material in which the lamella 10 is provided and the material of the stream of fluid can be altered. Changes in the material in which the lamella 10 is provided can be effected by altering the term Lv in the differential continuous wave equation (Equation 1) and the corresponding terms c1 to c6 as appropriate for the discrete recursion formula (Equation 2).

Changes in the material of the jet (or fluid stream) will have a corresponding impact on the pressure exerted by the fluid flow on the string. In particular, the pressure exerted by the fluid flow on the string will be affected by the viscosity of the fluid and the speed of flow. Weighting function W may be used to model this effect. In addition, as hinted at in the preceding paragraph, weighting function W may be used to model the case where the pressure distribution is not uniform, so that the pressure exerted by the fluid flow on the string will be affected by the pressure distribution. This may vary, for example, in dependence on the distance from the centre of the stream 30. Moreover, although the thickness and shape of the lamella are not taken into account in the preferred embodiment of the present invention, they can nonetheless be taken into account for more complex models.

Calculation of appropriate pressures for use in Equations 3 and 4 and loss coefficients for use in Equations 1 and 2 fall within the abilities of persons skilled in the art. Similarly, various formulations of functions C(u) and W(j, y[n, j]) will readily present themselves to persons skilled in the art. The simplest function C(u) would be C(u)=u, thus letting the force be proportional to the slope of the lamella in the z-direction.

In a preferred embodiment, the pressure is constant for any y-excursion and is a parameter that can be directly set by the user and can be modulated by velocity, low frequency oscillators (LFOs), envelope generators and the like.

In addition, turbulence in the air can be simulated by adding an appropriate random component to the force F[n, j] applied to discrete element j. The randomness of this component can be generated using, for example, lowpass filtered noise. Moreover, the degree of turbulence can be associated with the velocity, viscosity and/or other qualities of the stream of the fluid medium. It is to be noted that without this additional random force component the modelled lamella 10 at rest as shown in FIG. 2 could never be set into movement by a fluid stream 30 flowing only in the z-direction. This is because the slope of the lamella 10 in the z-direction would always be zero. In other words, (y[n, j]−y[n−1, j]) would always be zero and hence $F_{PRES}$ would also always be zero.

The force component due to turbulent air flow could for example be calculated as follows:

$$F_{TURBz}[n,j]=C_{TURBz}*W_{TURB}(j,y[n,j])*N_{RND}[n] \quad \text{(Equation 5)}$$

in which $C_{TURBz}$ denotes a turbulence coefficient;

$N_{RND}[n]$ denotes a random signal like lowpass filtered noise; and $W_{TURB}$ (j, y[n, j]) denotes a weighting function representing intensity of the turbulence in the air jet depending on the current x- and y-position of element j under consideration.

The term $W_{TURB}$(j, y[n, j]) in Equation 5 can be the same as W(j, y[n, j]) in Equations 3 and 4.

The resulting force acting on an element j due to the orthogonal blowing is:

$$F_z[n,j]=F_{PRESz}[n,j]+F_{TURBz}[n,j] \quad \text{(Equation 6)}$$

Equations 4 to 6 can be used to calculate the force acting on one or more discrete elements j at any given time n. This force can be substituted into an appropriate recursion formula, to calculate the excursion of each element of the string. In particular, in a preferred aspect of the present invention, Equation 6 is used in Equation 2 to calculate the excursion of each element j=1 . . . (x−2) in the lamella 10.

As previously discussed, as for the known string, for a lamella starting at rest an initial excursion y[0, j] of both the leading and trailing edges of each element j at time n=0 and before is zero (y[0, j]=0). The force F[0, j] on each element at time n=0 can be calculated and substituted into Equation 2 to calculate the excursion y[1, j] of the leading edge 40 of each element j at time n=1. Of course, at time n=0, excursion y=0 for all j and consequently the only component of force acting on any of the elements of the lamella 10 at rest is the component $F_{TURBz}$[0, j] due to turbulence.

Of course, the excursion of the leading and trailing edges of each of the supported elements j=0 and j=x−1 remains fixed at y=0 for all n. It should be noted that when using Equation 2 to calculate the excursion of the leading edge of the elements at time n=1, only the previous excursion of the leading edge at times n=0 and n=−1 is used. Of course, in this case y[0, j]=0 and y[−1, j]=0 for all j. Similar considerations apply in the use of Equations 4 to 6.

Since the excursion of elements j=1 to j=x−2 needs to be calculated using Equation 2 and Equation 2 requires elements j−2 and j+2 for calculating the next excursion of element j, additional dummy elements at j=−1 and at j=x are needed. As before, these dummy elements can be visualised as lying at the ends of the lamella outside the supports 20. At the rest position at time n=0, these dummy elements are assigned a position in alignment with the other elements. Thus, y[0, −1]=0 and y[0, x]=0 for both z=0 and z=dz. After each calculation of new excursions for all elements, the leading and trailing edges of these dummy elements are set to the negated relative excursion of the respective leading and trailing edges of their respective counterpart elements j=1 and j=x−2 on the other side of the supports 2. This is automatic for the trailing edge, since the data for the leading edge one time step before is used.

Starting from an initial excursion for each of the discrete elements j=0 . . . x−1 at time steps n=0 and n=−1, the excursion y for each discrete element j=1 . . . x−2 (in other words all the discrete elements between the supports) at time n=1 can be calculated using the recursion formula. Accordingly, for each further time step n=2, 3 . . . the new excursions for all elements can be calculated based on the excursions of the previous two time steps and the values of any external forces F[n, j] that have been applied for these time steps. Since the string will preferably initially be at rest, the initial excursion for each of the discrete elements at time steps n=0 and n=−1 will be y[−1, j]=0 and y[0, j]=0 for all j.

Specifically, the force acting on each element at time n=1 can then be recalculated and substituted into Equation 2 to calculate the excursion of the leading edge of each of the elements at time n=2. Since the leading edge of one or more elements will now have and excursion (y≠0) and the trailing edge of all the elements will have no excursion (y=0), at least some of the elements will have a slope in the z-direction. Thus, the term (y[n, j]−y[n−1, j])≠0 for those elements. Consequently, the force exerted on those elements will have a component both due to the stream of fluid and due to turbulence.

The force acting on each element at time n=2 can then be recalculated and substituted into Equation 2 to calculate the excursion of the leading edge of each of the elements at time n=3. The trailing edge of each element is now assigned the excursion of the leading edge of the respective element at time n=1. However, in order to calculate the excursion of the leading edge of each of the elements at time n=3, Equation 4 will use the excursion of the leading edge at time n=2. Thus, in general the excursion of the trailing edge will be different from the excursion of the leading edge and respective elements will exhibit a slope in the z-direction. Thus, the term (y[n, j]−y[n−1, j]) ≠0 for the respective elements. Consequently, the force exerted on those elements will have a component both due to the stream of fluid and due to turbulence.

Of course, if blowing in the z-direction is maintained, the movement of the elements will be accelerated or decelerated by the force resulting from the pressure. Moreover, the blowing pressure may be continuous and, consequently, self-sustained vibration can be set up.

In the preferred embodiments of the present invention, Equation 2 can therefore be used in combination with any one of Equations 4 to 6, but preferably Equation 6, to model the vibration of the lamella 10 as time progresses.

The present invention as described in the foregoing description can be used to simulate the blowing of a string of a musical instrument. There are many different ways in which the simulated vibration of the string can be used to create sound. For example, the force that the string applies to the right-hand support 20 can be calculated. This simulates the way a violin or acoustic guitar works in terms of sound radiation. Another way is to simulate an electromagnetic pick-up such as that used for an electric guitar by taking into account only the vibration of one element or a weighted sum of the vibrations of several neighbouring elements. Such methods are well known in the art and need not be described further.

In addition, the distance of the user's lips from the string and the shape of his mouth, and hence of the fluid flow, can be modelled and used to adjust the timbre of the note created. This can be done by varying the weighting functions W(j, y[n, j]) and $W_{TURB}$(j, y[n, j]), respectively. For example, the weighting functions can mimic a wide mouth by setting a more gradual pressure gradient between the elements and between different values of y for each element.

It is noted that in the preferred embodiment Equations 2 and 4 are used in combination to calculate the position of the leading edge 40 of the lamella 10 and that it is this leading edge 40 that is used to generate a corresponding sound. Of course, it would be equally possible to simulate the movement of the trailing edge 50—this is the same movement as of the leading edge but lagging by one discrete step in time—or of any other portion of the lamella in the z-direction.

It should be noted that in one embodiment of the present invention, excitation by fluid flow acting in both the x- and z-directions simultaneously can be modelled. Excitation by fluid flow acting in the x-direction is discussed in more detail below. In addition, any other means of exciting the string (such as the prior art methods of striking, plucking and bowing by directly applying a force in the y-direction) can be applied simultaneously.

As an alternative to, or as well as, providing a turbulence component in the force resulting from the fluid stream 30, it would be possible to provide the leading edge 40 or trailing edge 50 or both of one or more of the elements with an initial excursion at time n=0, so that it is/they are not aligned with the supported element j=x−1 in the x-direction or with each other in the y-direction. In that case, the stream of fluid 30 would immediately act to provide a force on the unaligned element(s), irrespective of whether a turbulence component is provided in the equation used to calculate force.

It should also be noted that in the present invention so far described, where fluid flow in the z-direction is described, only excitation by fluid flow exactly in the z-direction is described. However, it would be possible to provide a fluid flow having a component in the z-direction and a component in the y-direction. Specifically, the fluid flow would have an angle beta to the z-direction. In that case, any of Equations 4 to 6 could be adjusted to:

$$F_{zactual}=F_z \cos(\text{beta}) \qquad \text{(Equations 4a to 6a)}$$

A preferred embodiment in which fluid flow in the x-direction is also applied to the lamella 10 will now be described. In the following description, like reference numerals indicate like parts. Similarly, the x-, y- and z-directions are used consistently with the foregoing.

Figure 4:
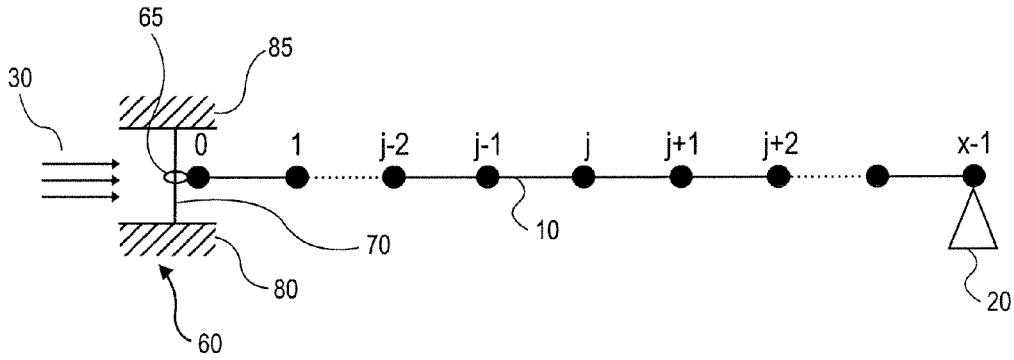
FIG. 4 is a view in the z-direction of a model of a string at rest according to another aspect of the present invention.
Figure 5:
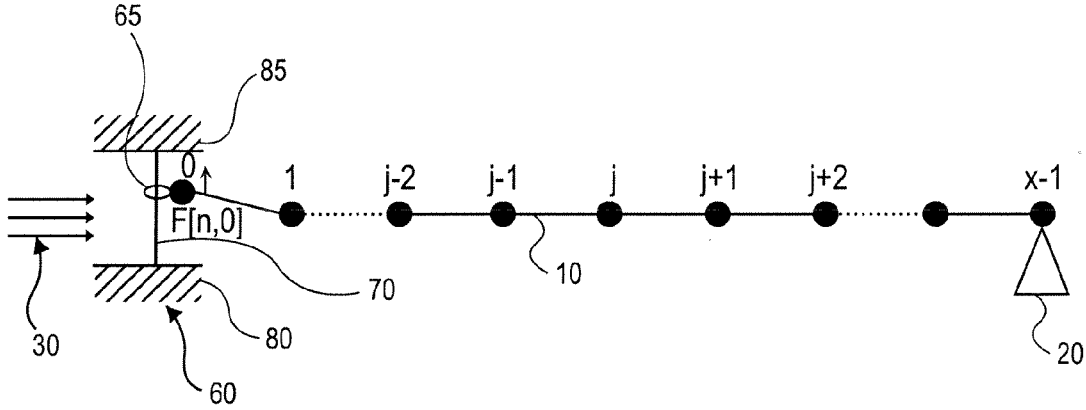
FIG. 5 is a view in the z-direction of the model shown in FIG. 4, but with a degree of excursion.

In one preferred arrangement for blowing the lamella in the x-direction, shown in elevation in FIGS. 4 and 5, the simulated lamella 10 is supported between two supports 20, 60 and is aligned at rest in an x-direction between the two supports 20, 60. One of the supports 20 (the right-hand support in FIG. 4 at position j=x−1) is again a rigid support that does not allow the supported discrete element any degree of freedom. Thus, support 20 acts in the same manner as before. The other support 60 (the left-hand support in FIG. 4 at position j=0) allows the supported element j=0 one degree of freedom in the y-direction.

In the arrangement shown in FIG. 4, the support 60 is envisaged as comprising a ring 65 attached to the supported element j=0. The ring 65 encircles a post 70, which is supported lengthways in the y-direction between upper and lower limits 80, 85. The movement of the ring 65 and hence of the supported element j=0 is limited within a certain range between the upper and lower limits 80, 85. However, this specific structure need not be used. Rather, it is sufficient that one of the supports can be envisaged as being movable only in the y-direction and that the supported element j=0 is rigidly attached to the support and has the same movement as the support. Thus, the excursion of the supported element j=0 can be limited for example between y[n, 0]=−a . . . +a.

The limits 80, 85 may be fixed or variable. In addition, they may be hard or cushioned to damp the movement of the supported element j=0 at the limits. Moreover, the distance from the lower limit 80 to the rest position of the supported element j=0 need not be the same as the distance from the upper limit 85 to the rest position.

The limits 80, 85 can be interpreted as the lips of a musician blowing along the lamella 10 and movement of the supported element j=0 between the limits 80, 85 can be interpreted as the movement of the lamella 10 in the clearance between the lips of the musician.

As noted above and shown in FIG. 4, the lamella 10 is aligned at rest in the x-direction between the two supports 20, 60. In the present invention, a simulated stream 30 of air or another fluid is blown from between the limits 80, 85 in the x-direction. As shown in FIG. 5, when a portion of the lamella 10 between the two leftmost elements—that is, between j=0 and j=1—is not aligned with the stream 30, it exerts a pressure and consequent force 200 on that section. The force from this pressure 200 causes the supported element j=0 to move in the y-direction until it reaches a "lip" limit 80, 85. In the example shown in FIGS. 2 and 3, this movement propagates along the lamella 10 towards the left and is reflected at the rigid support 20 at the right-most end of the lamella 10 and returns with inverted sign to the left support 60. As a result, the supported element j=0 will move towards the opposite "lip" limit 80, 85. Again, if the blowing pressure is continuous, self-sustained vibration can be set up.

In summary, the lamella is in most respects unchanged. However, in contrast to the model shown in FIGS. 2 and 3, the lamella is rigidly supported only at discrete element j=x−1 at the right-hand end by support 20. The support 60 at discrete element j=0 at the left-hand end allows one degree of freedom in the y-direction, with cushioned or hard limitation of the possible range of excursion for this supported element.

The force 200 in the y-direction experienced by supported element j=0 due to the pressure exerted by the stream of fluid 90 on the left-most portion of the lamella 10 between elements j=0 and j=1 can be approximated as follows:

$$F_{PRESx}[n, 0] = P_x * \tan(\text{alpha}) = P_x * (y[n, 0] - y[n, 1])/dx \quad \text{(Equation 7)}$$

in which:

$P_x$ denotes the pressure exerted by the stream of fluid 90 on the lamella;

y[n, 0] denotes the excursion of the supported element (j=0) at time n;

y[n, 1] denotes the excursion of the first element (j=1) to the right of the supported element (j=0) at time n; and (alpha) denotes the angle between the portion of the lamella 10 between elements j=0 and j=1 with the x-direction.

It is noted that Equation 7 is different to Equation 4 since in equation 7 the torsion in a string is not being modelled. Consequently, there is no need to take account of the extension dz in the z-direction and function C is omitted. In other words, effectively only a string lying along the leading edge 40 of the lamella 10 is considered.

Optionally, the direction of the stream of fluid 90 may deviate by an angle (gamma) from the x-direction but in the plane of vibration. In this case, the force 200 on the supported element j=0 will be:

$$F_{PRESx}[n,0]=P_x*\tan(\text{alpha}+\text{gamma}) \quad \text{(Equation 7b)}$$

By providing one degree of freedom in the y-direction for the supported element j=0, a force caused by an air/fluid stream 30 can move element j=0 within the range allowed by the limiting "lips" 80, 85. Moreover, by providing an uninterrupted air jet the modelled lamella may have self-sustained oscillations.

As before, various changes in materials can be modelled by adjusting the coefficients in the various equations and a turbulence component can be added in a similar way.

Of course, if the stream 30 flows at an angle (gamma) from the x-direction, the lamella 10 may be set into motion without introducing a turbulence factor. In this case, the term tan(alpha+gamma) will be non-zero and a force 200 will act on the supported element j=0

However, in the preferred arrangement of the present invention, the simulated turbulent force excites the supported element j=0 out of the rest position aligned with the x-direction. This creates an angle alpha between the portion of the lamella 10 between elements j=0 and j=1 and the x-direction. The stream 90 of fluid flowing in the x-direction can then exert a pressure on one the supported element, as discussed above.

The force component due to turbulent airflow at time n on supported element j=0 could for example be calculated as follows:

$$F_{TURBx}[n,0]=C_{TURB}*N_{RND}[n] \quad \text{(Equation 8)}$$

in which:

$C_{TURB}$ denotes a turbulence coefficient; and $N_{RND}$[n] denotes a random signal, such as lowpass filtered noise.

Note that Equation 8 is different to Equation 4 in that it does not include a weighting function W. However, the same or a similar function could also be included in Equation 8. As for blowing in the z-direction, other ways of introducing or modelling the force due to turbulence will be apparent to those skilled in the art.

The limiting of the movement of the supported element j=0 between a range due to the "lip" clearance can be realised in different ways. For example, limiting of the movement can be implemented by simulating damped springs that push supported element j=0 back into the allowed range as soon as its excursion y[n, 0] exceeds that range. A drawback of this implementation is that the resulting model tends to become unstable. Alternatively the new excursion can be calculated based on the sum of $F_{PRES}$ and $F_{TURB}$ and then be limited afterwards, using either cushioned or hard limits. This alternative approach does not model a practical mechanical system so accurately, but still retains the main aspects of such a system with minimum computational effort and improved model stability.

The new excursion for the supported element j=0 can thus be calculated as follows:

$$y_{intermediate}=y[n,0]+(F_{PRES}[n,0]+F_{TURB}[n,0])*dt^2/M[0]$$

$$y[n+1,0]=\text{Limit}(y_{intermediate}) \quad \text{(Equation 9)}$$

in which:

M[0] denotes the mass of the supported element j=0; and

Limit(y) is a limiting function.

For hard limiting, the limiting function Limit(y) could for example be defined as:

Limit( )::Maximum(Minimum(y,lower bound),upper bound).

In other words, for positive values of excursion y the value of Limit(y) is the lower of the values of y and the upper bound; and for negative values of y the value of Limit(y) is the higher (or more positive) of the values of y and the lower bound. For cushioned limiting, the limiting function Limit(y) could for example be defined as:

```
Limit( )::(upper bound+lower bound)/2+(upper
    bound−lower bound)/2*tan h((y−(upper bound+
    lower bound)/2)/((upper bound−lower bound)/
    2))
```

The tan h function behaves nearly linearly for absolute values around 0 but approaches non-linearly 1 or −1 respectively for higher absolute values. However, the value of the tan h function never reaches 1 or −1. Increasing positive values of y will lead to increasing positive values of the tan h function up to 1. Similarly, increasing negative values of y will lead to increasing negative values of the tan h function up to −1. Accordingly, once the respective upper and lower limits 80, 85—termed upper bound and lower bound in the two limiting formulae above—are set, with 0 being aligned with the right-hand support 20 in the x-direction, then the value of the Limit(y) of will approach those upper and lower limits as the value of y approaches those limits. However, the approach of Limit(y) to the limits will be cushioned compared to that of the excursion y.

Figure 3:
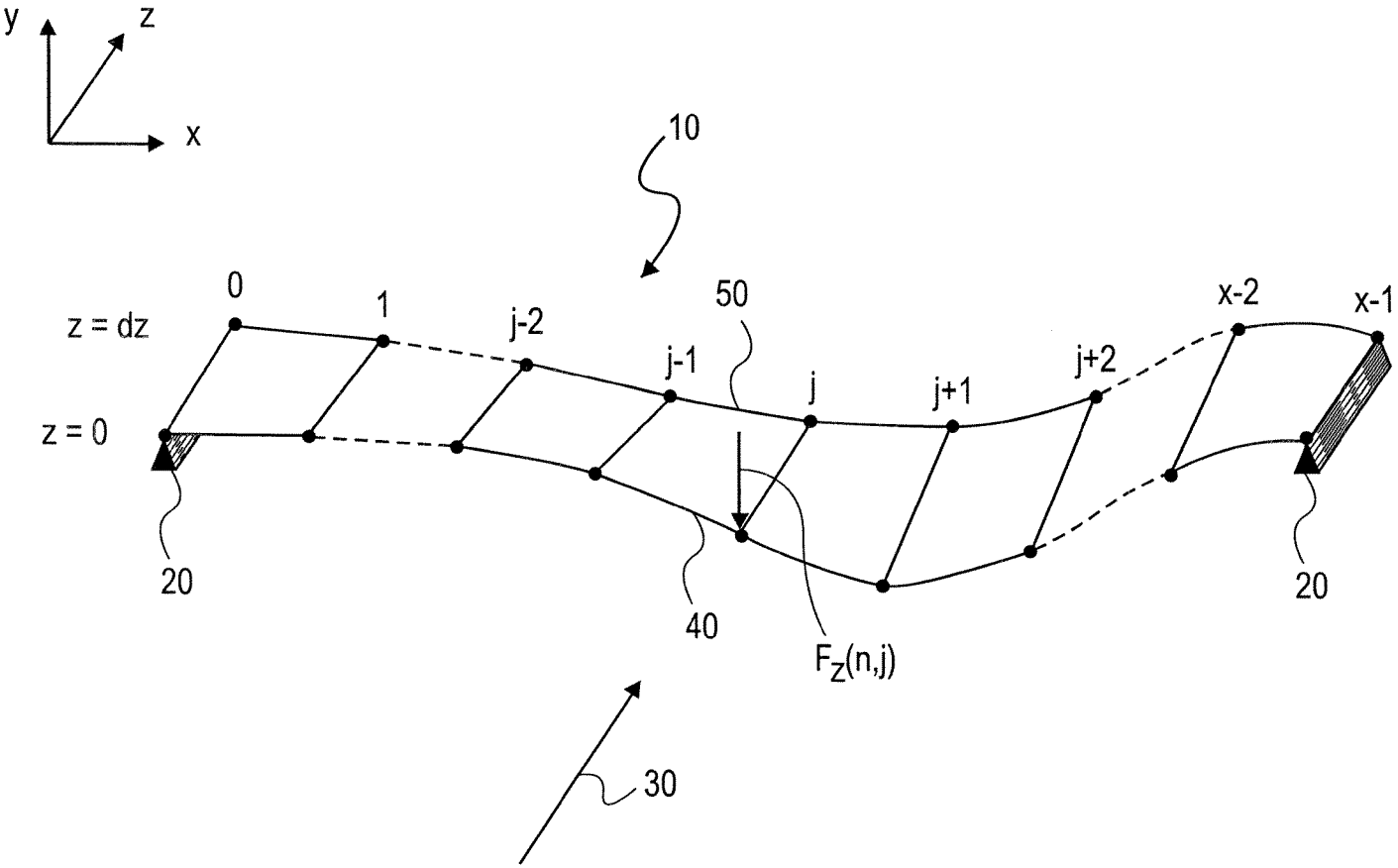
FIG. 3 is a perspective view of a model shown in FIG. 2, but with a degree of excursion according to the present invention.

In the prior art shown in FIG. 1 and in the orthogonal blowing of the present invention described with reference to FIGS. 2 and 3, since the string 100 or lamella 10 is immovably supported at both ends by supports, the recursion formula shown in Equation 2 is used to calculate the excursions only of the discrete elements between the supports—in other words, for elements j=1 to j=x−2. Similarly, in this embodiment of the present invention, excursions are calculated only for the discrete elements between the supports—in other words, for elements j=1 to j=x−2. The excursion of the movably supported element j=0 is calculated only using Equation 9 and the immovably supported element j=x−1 has no excursion.

In a realistic model using the precepts of the present invention, the recursion formula shown as Equation 2 would also be used to calculate the excursion for j=0 for each time step n, with $F[n, 0]=F_{PRES}[n, 0]+F_{TURB}[n, 0]$. This would take account of the effect of wave propagation on the movably supported element j=0. However, that would detune the simulated lamella in a non-linear way. In other words, the lamella would effectively be lengthened by dx, which is the distance between discrete element j=0 and j=1. Thus, the lamella would be lengthened by a factor (x−1)/(x−2). However, it would have the same tension and the recursion formula would use the same values for the coefficients c1 to c6. Accordingly, the lamella would be detuned downwards and hence tones would have a lower pitch.

It would be possible separately to calculate the tension for the required tone pitch. However, in the preferred arrangement the user is able to set the "lip clearance" parameter or the value of the upper and lower limits. If the user sets the lips closed so that the upper and lower limits are both zero, then the lamella is effectively immovably supported at both ends with the discrete element fixed in the y-direction. In that case, the lamella is effectively be shortened again and the resulting pitch increases.

It is preferable if dependency of the pitch on the lip clearance in this way is removed. This becomes more important for sounds where the parameters vary over time. Bearing in mind that the preferred arrangement of the present invention is intended to maintain the ability to excite the lamella by means other than blowing, one example of the parameters varying in time is a gradual reduction in the value of "lip clearance" parameter from 2.0 to 0.0 over a period of 2 seconds and a gradual increase in the bowing speed over the same period.

Accordingly, the recursion formula is preferably still only calculated for j=1 . . . x−1, while the excursion of the supported element j=0 is calculated using Equation 9. This allows a user to change the intensity of excitation in terms of both fluid medium (or blow) pressure and "lip clearance" without unwanted side effects.

As before, the recursion element is used to calculate the change in the value of y for each element as time progresses. Briefly, starting at time n=0, the force F[0, 0] exerted on the supported element j=0 can be calculated. The excursion of all elements j=1 to j=x−2 between the supports at time n=0 will be zero.

Subsequently, the excursion y[1, 0] of the supported element j=0 at time n=1 from its rest position due to the fluid flow including turbulence can be calculated using Equation 9.

Since the force has only acted on the portion of lamella between elements j=0 and j=1 at time n=1, there will be no effect on the other elements of the lamella at this time. Thus, using Equation 2, the excursion of all elements j=2 to j=x−2 will still be set at zero at time n=1.

However, at time n=2 the force on element j=0 will have acted to effect other elements on the lamella. In other words, the movement of element j=0 will have begun propagating down the lamella.

Since the excursion of elements j=1 and j=x−2 needs to be calculated using the recursion formula and the recursion formula requires elements j−2 and j+2 for calculating the next excursion of element j, additional dummy elements at j=−1 and at j=x are needed. These dummy elements can be visualised as lying at the ends of the lamella outside the supports 20, 60. At the rest position at time n=0, these dummy elements are assigned a position in alignment with the other elements. Thus, y[0, −1]=0 and y[0, x]=0. After each calculation of new excursions for all elements, these dummy elements are set to the negated relative excursion of their respective counterpart elements j=1 and j=x−2 on the other side of the supports 20, 60.

Consequently, the excursion y[n+1, −1] of the left dummy element for the next sample is given by:

$$y[n+1,-1]=y[n+1,0]-(y[n+1,1]-y[n+1,0]) \quad \text{(Equation 10)}$$

Similarly, the excursion y[n+1, x] of dummy element j=x at the opposite extreme end for the next sample is given by:

$$y[n+1,x]=-y[n+1,x-2] \quad \text{(Equation 11)}$$

since y[n, x−1] is always zero.

From the discrete recursion formula shown as Equation 2, it can be seen that at time n=1 the oscillation will have propagated from element j=0 as far as element j=2, since this formula uses the terms j−2 and j−1.

The excursion of all the elements j=1 to j=x−2 can then be calculated using the recursion formula shown as Equation 2 for n=2, 3, 4, and so forth. This will illustrate the progression of the wave along the lamella.

What is more, the discrete recursion formula can also be used to calculate the combined effects of other forces caused by both orthogonal and longitudinal blowing in the lamella 10. This can be achieved by setting the force acting on the leading edge of any one element as:

$$F_{combined}[n,j]=F_z[n,j]+F[n,j] \quad \text{(Equation 12)}$$

It is noted that in the foregoing description, one stream of fluid 30 flows in the z-direction and one stream of fluid 30 flows in the x-direction. The respective forces attributable to the two streams of fluid are then added to calculate the excursion of the leading edge of each element. Of course, it would also be possible to model one stream of fluid flowing in a direction having both a component in the x-direction and a component in the z-direction. Trigonometric functions could then be used to calculate the force attributable to these separate components and hence calculate the excursion. In addition, it is noted that at the choice of the user the force attributable to only one of these components could be used. Moreover, as is clear from the foregoing, the model allows excitation of the lamella shown in FIGS. 4 and 5 with a stream of fluid flowing only in the x-direction.

The discrete recursion formula can also be used to calculate the additional effects of other forces (for example due to striking, plucking or bowing) applied to discrete elements of the lamella 10 between the two supports at the same time if required. In other words, the simulated lamella of the present invention can not only be "blown" in the orthogonal direction, it can also be blown in the longitudinal direction, and struck or otherwise excited using a model piano hammer, plectrum, bow and so forth. Moreover, the lamella can be struck, plucked, bowed and so on at the same time it is being blown in either or both directions.

The foregoing description of blowing in the longitudinal direction assumes that the stream of fluid flowing in the x-direction or at an angle beta to the x-direction exerts a pressure only on the portion of the lamella between the supported element j=0 and the next element j=1 and not on any other portions of the lamella. This results in a comparatively simple but effective model that is not computationally expensive.

However, the model can be further refined by assuming that the stream of fluid flowing in the x-direction also exerts a force on other portions of the lamella once they have been excited. In particular, as soon as any discrete element is no longer aligned with the right-hand support 20 in the x-direction, then the stream of fluid 90 can be assumed to exert a pressure on the portions of the lamella between that element and the elements adjacent to it. This pressure can be assumed to be dependent on the distance of the left end of the lamella, for example so that P[j] decreases linearly or exponentially with increasing j.

In this case, the force F[n, j] at time n acting on each discrete element from j=1 to j=x−2 due to the pressure can be mathematically modelled as:

$$F[n,j]=P[j]*(y[n,j]-y[n,j-1])/dx+P[j+1]*(y[n,j]-y[n,j+1])/dx \quad \text{(Equation 12)}$$

If the discrete recursion formula shown as Equation 2 is to be used, with the simplifying assumptions that dx=1 and dt=1, then Equation 10 can be simplified as follows:

$$F[n,j]=P[j]*(y[n,j]-y[n,j-1])+P[j+1]*(y[n,j]-y[n,j+1]) \quad \text{(Equation 13)}$$

Again, turbulence in the air would preferably be simulated by adding an appropriate random component to the force F[n, j] applied to each discrete element j=1 to j=x−2 between the supports.

This assumes that the fluid flow acts on all "unaligned" portions of the lamella equally—in other words, each discrete element having an excursion at a particular time has a force acting on it due to the pressure exerted by the fluid flow and, apart from "blow" pressure, the magnitude of that force is dependent only on the excursion of the element in question and of the neighbouring elements. However, it would be possible to further model how the positioning of the elements of the lamella affects the flow of the fluid stream itself. In particular, it would be possible to model how the discrete elements in the lamella create eddy currents in the fluid flow and how upstream discrete elements can "shadow" downstream discrete elements and therefore effect the force acting on them. For example, as hinted at above, a function similar to function W used in Equation 4 could be used.

The modelling of how the positioning of the elements of the lamella affects the flow of the fluid stream itself, especially the modelling of eddy currents, would increase the computational cost of the model significantly and require either or both more powerful processors or longer processing time. As an alternative, a simplified "shadowing" algorithm can be provided in which the remaining pressure at position j not only decreases with increasing j, but is also reduced by a certain amount at each preceding "shadowing" section.

As with orthogonal blowing, various alternatives to providing a turbulence component can be used.

In the present invention, various parameters can be set by the user and will affect the resultant oscillations of the lamella and the consequent sound output. For example, the clearance between the user's lips and the blow pressure can be used to adjust the timbre of the note created.

In common with the blow pressure, the value of the lip clearance parameter can be set by a user and can be modulated by velocity, LFOs, envelope generators, external control signals and the like.

As the value for the lip clearance setting increases, so the volume of the sound output increases. Similarly, increasing the pressure creates extra brilliance in the sound and forces the model into higher modes. In other words, in common with a flute, the pitch of a note can be raised to higher modes of vibration by blowing harder, for example to one octave above.

Figure 6:
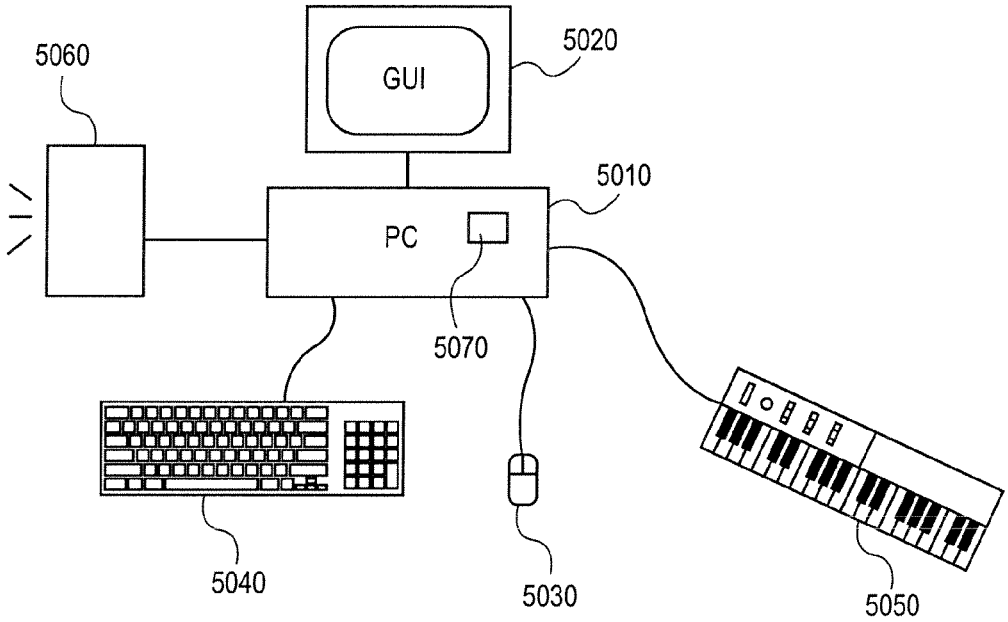
FIG. 6 shows one embodiment of an apparatus according to the present invention, in which a personal computer is programmed to run a synthesiser application program.

The present invention may be implemented in a synthesiser application program run by a personal computer (PC) 5010 with a processor 5070, as shown in FIG. 6. In addition to the PC 5010 and its processor 5070, such an implementation may use a monitor 5020, a mouse 5030, a keyboard 5040, a speaker 5060 and optionally a further, piano-style keyboard 5050. In that case, the monitor 5020 of the PC 5010 is preferably used to display the simulated lamella 10 and the various exciters. The mouse 5030 and keyboard are preferably used to select preferred parameter values for the method. Previously selected parameter values may have been created by the user or may have been created by the programmer and stored together with or separately from the synthesiser application program. It will be appreciated that a typical data processing system will include a processor (such as a G5 microprocessor from IBM or a Pentium microprocessor from Intel) and a bus and a memory (which is a form of machine readable medium). The processor and memory are coupled to the bus, and the memory stores the application program (usually an executable computer program) which provides the instructions to the processor, which performs the operations (eg simulations of a string/lamella), specified by the instructions. A typical data processing system is shown in U.S. Pat. No. 6,222,549, which is hereby incorporated herein by reference.

An apparatus of the present invention is not limited to an appropriately programmed PC and peripheral devices. It also includes any specifically designed, stand alone or intermediate apparatuses.

The foregoing description has been given by way of example only and it will be appreciated by a person skilled in the art that modifications can be made without departing from the spirit or the scope of the present invention. In particular, references to the left and right are not intended as limiting references.

The invention claimed is:

1. A method, comprising:

simulating a string using a wave equation that relates movement of the string in time to force acting on the string, wherein the string has a longitudinal axis in a first direction and is moveable in a second direction orthogonal to the first direction, and the force acting on the string simulates a stream of a fluid medium flowing relative to the string in a direction having a component in a third direction orthogonal to both the first and second directions; and creating sounds using the wave equation.

2. A method according to claim 1, wherein the simulated string is supported between two supports, is aligned at rest in the first direction and has a depth in the third direction, whereby the string has a leading edge closer to a source of the stream of fluid medium and a trailing edge further from the source of the stream of fluid medium.

3. A method according to claim 2, wherein the string is caused from rest to vibrate in a plane, which includes the first and second directions, by turbulence in the fluid flow causing the stream of fluid medium to exert a pressure on the string in the second direction.

4. A method according to claim 2 or claim 3, wherein:

when the leading and trailing edges are out of alignment with one another, the stream of fluid medium exerts a force on the string in the second direction.

5. A method, comprising:

simulating a string using a wave equation that relates movement of the string in time to force acting on the string, wherein the string has a longitudinal axis in an x-direction and a depth in a z-third direction orthogonal to the x-direction;

the string is supported between two supports whereby it is aligned at rest in the x-direction and is moveable in a y-direction orthogonal to the x- and z-directions;

and the force acting on the string simulates a stream of a fluid medium flowing relative to the string in a direction having a component in a z-direction, whereby the string has a leading edge closer to a source of the stream of fluid medium and a trailing edge further from the source of the stream of fluid medium; and creating sounds using the wave equation.

6. A method according to claim 5, wherein the string comprises a plurality of discrete elements aligned at rest in the x-direction and spaced apart by a distance dx, each element having a depth dz; and the leading and trailing edges of the discrete elements are able to move in discrete steps of time dt in the y-direction only.

7. A method according to any one of claims 1, 2, 3, 5, or 6, wherein the wave equation is an approximation of the continuous wave equation $$M\frac{\partial^2 y}{\partial t^2} = T\frac{\partial^2 y}{\partial x^2} - S\frac{\partial^4 y}{\partial x^4} + L_T\frac{\partial^3 y}{\partial x^2 \partial t} - L_s\frac{\partial^5 y}{\partial x^4 \partial t} - L_v\frac{\partial y}{\partial t} + F(x, t)$$

in which:

F(x, t) denotes an external force at coordinate x on the string at time to

M denotes mass per length;

S denotes stiffness of the string;

T denotes tension of the string;

Ls denotes a loss associated with the stiffness of the string;

Lt denotes a loss associated with the tension of the string; and

Lv denotes a loss associated with the turbulent flow of the fluid medium.

8. A method according to claim 7, in which the string comprises a plurality of j discrete elements from j=0 at one end supported by a first support to j=x−1 at the opposite end supported by a second support; wherein j is an integer; and the stream of fluid medium flows at least partly in the z-direction and exerts a pressure on the elements of the string.

9. A method according to claim 8, wherein the force $F_{PRESz}$[n, j] at time n acting on an element j due to the pressure on the string is given by;

$$F_{PRESz}[n,j]=P_z*(C((y[n,j]-y[n-1,j])/dz))/dt^2*W(j,y[n,j])$$

in which:

$P_z$ denotes the pressure exerted by the stream of fluid 30 on the lamella;

C((y[n, j]−y[n−1, j])/dz) denotes a function of (y[n, j]−y[n−1, j])/dz in respect of the dependency of the force acting on each element j due to the torsion of the lamella; and W(j, y[n, j]) denotes a weighting function representing the intensity of the stream of fluid depending on the current x- and y-position of the element j under consideration.

10. A method according to claim 8, wherein the approximation of the continuous wave equation is the discrete recursion formula:

$$y[n+1,j]=(y[n,j-2]\cdot c1+y[n,j-1]\cdot c2+y[n,j]\cdot c3+y[n,j+1]\cdot c2+y[n,j+2]\cdot c1+y[n-1,j-2]\cdot c4+y[n-1,j-1]\cdot c5+y[n-1,j]\cdot c6+y[n1,j+1]\cdot c5+y[n-1,j+2]\cdot c4)/M[j]+2y[n,j]+F[n,j]/M[j]$$

in which:

dx=1;

dt=1;

y[n, j] denotes the excursion of discrete element j in the y-direction at time n;

y[n+1, j] denotes the excursion of discrete element j in the y-direction at time n+1;

y[n, j+1] denotes the excursion of discrete element j+1 in the y-direction at time n;

M[j] denotes the mass of discrete element j;

F[n, j] denotes an additional external force acting on a discrete element j at time n; and c1 to c6 are coefficients, which depend on the material parameters of the string and the surrounding media.

11. A method according to claim 10, wherein $$c1=-(S+Ls);$$

$$c2=T+4S+Lt+4Ls;$$

$$c3=-(2T+6S+Lv+2Lt+6Ls);$$

$$c4=Ls;$$

$$c5=-(Lt+4Ls);\text{ and}$$

$$c6=Lv+2Lt+6Ls.$$

12. A method according to claim 10, wherein when dz=1 the force $F_{PRESz}[n, j]$ at time n acting on an element j due to the pressure on the string is given by:

$$F_{PRESz}[n,j]=P_z*(C(y[n,j]-y[n-1,j]))*W(j,y[n,j])$$

in which:

$P_z$ denotes the pressure exerted by the stream of fluid 30 on the lamella;

C((y[n, j]−y[n−1, j])/dz) denotes a function of (y[n, j]−y[n−1, j])/dz in respect of the dependency of the force acting on each element j due to the torsion of the lamella; and W(j, y[n, j]) denotes a weighting function representing the intensity of the stream of fluid depending on the current x- and y-position of the element j under consideration.

13. A method according to claim 12, wherein the force $F_{TURB}[n, j]$ at time n acting on an $$F_{TURBz}[n,j]=C_{TURBz}*W_{TURB}(j,y[n,j])*N_{RND}[n]$$

in which $C_{TURBz}$ denotes a turbulence coefficient;

$N_{RND}[n]$ denotes a random signal; and $W_{TURB}(j, y[n, j])$ denotes a weighting function representing intensity of the turbulence in the air jet depending on the current x- and y-position of element j under consideration.

14. A method according to claim 13, wherein the random signal comprises a low pass filtered noise.

15. A method according to claim 13, wherein the total force at time n acting on an element $$F_z[n,j]=F_{PRESz}[n,j]+F_{TURBz}[n,j].$$

16. A method according to claim 12, in which the fluid flow is orthogonal to the x-direction but at an angle beta to the z-direction, wherein the equation for force is modified to:

$$F_{zactual}=F_z \cos(\text{beta}).$$

17. A method according to claim 10, wherein the elements at the supports are not movable so y=0 for these elements and the discrete recursion formula is solved for the elements adjacent the respective supports by providing a dummy element at opposite ends of the string so that the excursion y[n+1, −1] of a dummy element j=−1 adjacent one support for the next discrete time n+1 is given by:

$$y[n+1,-1]=-y[n+1,1]$$

and the excursion y[n+1, x] of a dummy element j=x adjacent the other support for the next sample n+1 is given by:

$$y[n+1,x]=-y[n+1,x-2].$$

18. A method according to claim 5, wherein the elements at the supports do not move.

19. A method according to claim 5, wherein a support at one end of the string and the corresponding element are moveable in the y-direction.

20. A method according to any one of claim 1 to 3, wherein the force acting on the string further simulates a stream of fluid flowing relative to the string in a direction having a component in the first direction.

21. A method according to claim 5, wherein the force acting on the string further simulates a stream of fluid flowing relative to the string in a direction having a component in the x-direction.

22. A method according to any one of claims 1, 2, 3, or 5, further comprising generating a sound based on movement of the simulated string.

23. An apparatus for performing a method according to any one of claims 1 to 3 and 5.

24. An apparatus according to claim 23, wherein the apparatus comprises a computer.

25. An apparatus according to claim 24, wherein the apparatus further comprises a loudspeaker.

26. A sound synthesiser comprising an apparatus according to claim 23.

27. A machine-readable medium containing a computer program for causing a computer to carry out the method according to any one claims 1 to 3 and 5.

28. A storage medium storing a computer program according to claim 27.

29. A machine readable medium containing executable program instructions which when executed on a data processing system cause the data processing system to perform a method comprising:

simulating a string using a wave equation that relates movement of the string in time to a force acting on the string, wherein the string has a longitudinal axis in a first direction and is moveable in a second direction orthogonal to the first direction, simulating a stream of fluid medium flowing relative to the string in a direction having a component in a third direction orthogonal to both the first and the second directions to provide the force acting on the string; and producing data from the simulating to create sounds.

30. A machine readable medium as in claim 29 wherein the method further comprises:

producing the sounds through a speaker.

* * * * *